United States Patent [19]

Roth et al.

[11] 4,222,486

[45] Sep. 16, 1980

[54] DEVICE FOR REMOVABLY STORING DRILL BITS

[76] Inventors: Leo Roth; Ursula Roth, both of 52-27 69th St., Maspeth, N.Y. 11378

[21] Appl. No.: 49,183

[22] Filed: Jun. 18, 1979

[51] Int. Cl.[3] ..... B65D 85/20; B65D 83/02; B65D 85/26

[52] U.S. Cl. ..... 206/379; 222/142.8; 312/73; 221/91

[58] Field of Search ..... 206/379; 312/73, 97.1; 222/142.8; 221/91

[56] References Cited

U.S. PATENT DOCUMENTS

| | | | |
|---|---|---|---|
| 702,904 | 6/1902 | Abraham | 206/379 |
| 2,047,081 | 7/1936 | Roch et al. | 222/142.8 |
| 2,351,815 | 6/1944 | Jensen | 312/73 |
| 3,254,928 | 6/1966 | Clatterbuck | 312/97.1 |

*Primary Examiner*—William T. Dixson, Jr.

[57] ABSTRACT

A vertical cylindrically shaped container has a top surface defining a flat horizontal spiral which has an inner and substantially coincident with the longitudinal axis of said container and has an outer end at the outer periphery of said surface. The spiral has a plurality of spaced holes disposed along the path defined by the spiral, whereby a separate drill bit can be removably disposed in a corresponding hole and extends in a direction parallel to said axis. An elongated slider element having an opening therein slidably engages said spiral whereby said element can be moved back and forth therealong, said opening overlying said spiral. A circular cover overlying said top end is manually rotatable thereabout, said cover having a radial slot therein extending from the center to the periphery, the element extending upwardly through said slot and being slidable therein whereby said opening can be selectively aligned with any one of said holes and access to all other holes is blocked simultaneously.

5 Claims, 7 Drawing Figures

Fig. 1
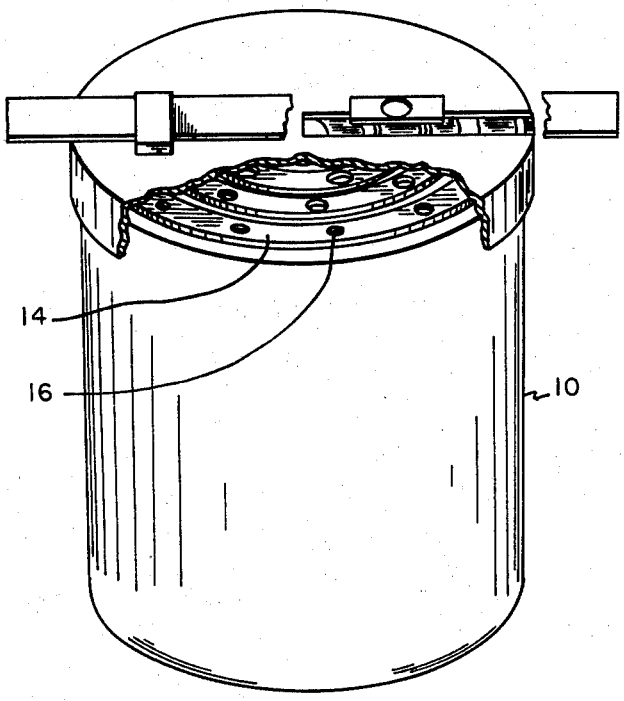
Fig. 2
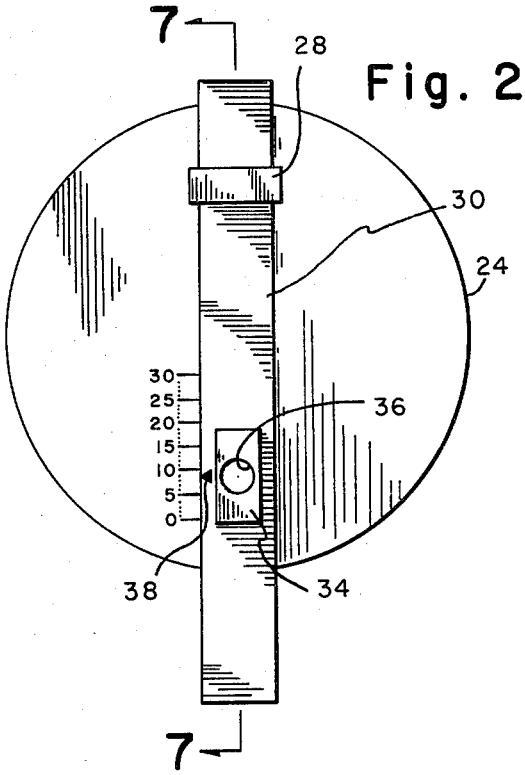
Fig. 3
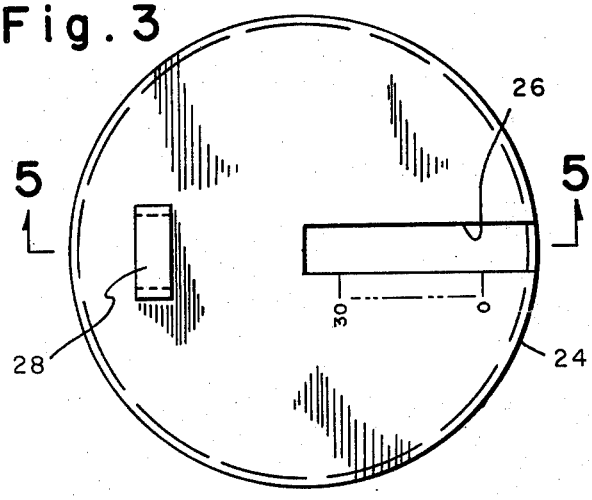
Fig. 4
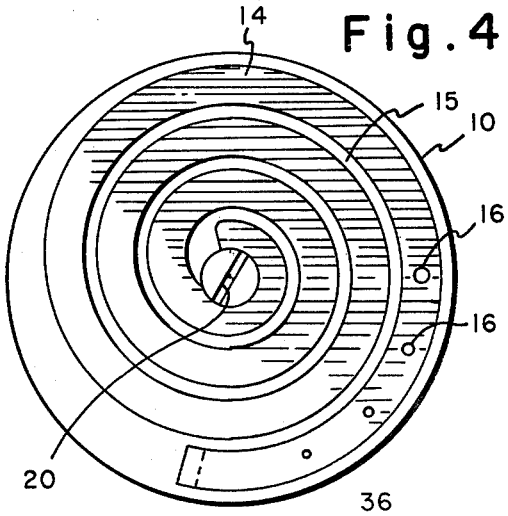
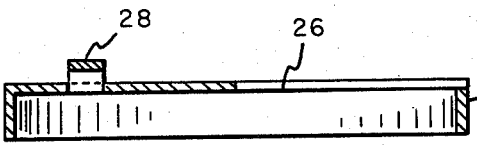
Fig. 5
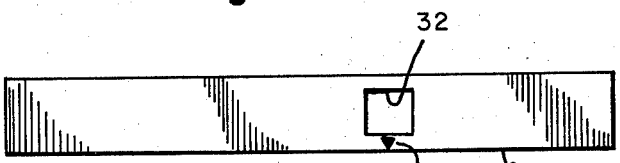
Fig. 6
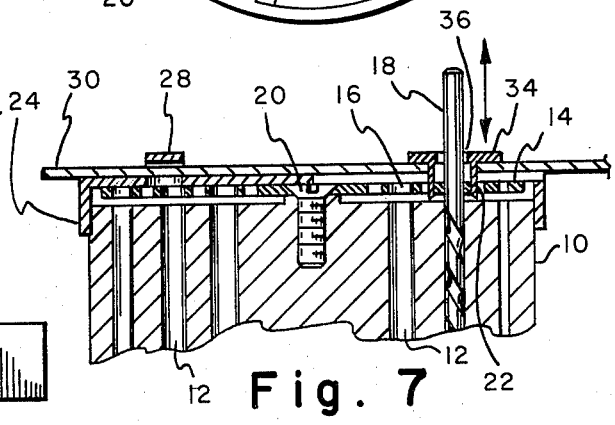
Fig. 7

DEVICE FOR REMOVABLY STORING DRILL BITS

BACKGROUND OF THE INVENTION

Drill bits, as used for example in electric drills, are conventionally disposed removably in corresponding bores in a rectangular container with the bores disposed along several parallel straight paths. When the container is disposed in vertically upright position with a top cover open, any bit can be selected and removed maually. However, it is often difficult to select a particular drill size because adjacent drill bits are closely spaced and the marking of the size is often difficult to read. Moreover, if the container is knocked over accidentally or inverted, all of the bits can spill out whereby the drills must be carefully collected and replaced manually, one at a time, to insure that each bit is replaced in the proper bore.

The present invention overcomes these difficulties thereby any desired bit can be quickly and easily selected, removed and replaced and, in addition, only one bit can be removed at a time in such manner that no more than one bit can spill out if the container is knocked over accidentally or is inverted.

SUMMARY OF THE INVENTION

In accordance with the principles of this invention, a device is provided which is adapted for removably storing a plurality of elongated drill bits of circular cross section, said bits having different diameters. The device comprises a vertical cylindrically shaped container having a top surface defining a flat horizontal spiral. The spiral has an inner and substantially coincident with the longitudinal axis of said container and has an outer end at the outer periphery of said surface. The spiral also has a plurality of spaced holes disposed along the path defined by the spiral, whereby each bit can be removably disposed in a corresponding hole and extends in a direction parallel to said axis.

An elongated slider element has an opening therein and slidably engaging said spiral whereby said element can be moved back and forth therealong, said opening overlying said spiral.

A circular cover overlying said top end and is manually rotatable thereabout. The cover has a radial slot therein extending from the center to the periphery, the element extending upwardly through said slot and being slidable therein whereby said opening can be selectively aligned with any one of said holes and access to all other holes is blocked simultaneously.

In use the container can be held in one hand while the other hand rotates the cover about the container. The element then traverses the spiral successively exposing each of the holes in sequence whereby any bit can be removed while access to all other bits is blocked. The element can be moved in either direction along the spiral from the inner end of the spiral to the outer end or vice versa by rotating the cover in either clockwise or counterclockwise direction.

Typically the container is provided with a like plurality of spaced axially disposed bores, each bore being adapted to receive a corresponding bit, each bore being aligned with a corresponding hole.

The holes (and corresponding bores) can differ in diameter, each hole having the same diameter as its corresponding bore to facilitate storage of bits of different diameter.

BRIEF DESCRIPTION OF THE DRAWINGS

FIG. 1 is a partially cut away perspective view of the invention.

FIG. 2 is a top plan view thereof.

FIG. 3 is a top plan view of the cover used in the invention.

FIG. 4 is a top plan view of the invention with the cover removed.

FIG. 5 is a view taken along line 5—5 in FIG. 3.

FIG. 6 is a plan view of the slider support strip used in the invention.

FIG. 7 is a partially cut away vertical cross section taken along line 7—7 in FIG. 2.

DETAILED DESCRIPTION OF PREFERRED EMBODIMENTS

Referring now to FIGS. 1–7, a vertical solid cylinder 10 has a plurality of spaced vertical bores 12 therein. A flat horizontal spiral 14 overlies and is spaced above the cylinder. The spiral has a groove with an inner end overlying the center of the cylinder and outer end slightly spaced inwardly from the outer periphery of the cylinder. The spiral carries a plurality of holes 16 spaced apart from each other and disposed along the path defined by the spiral. Each hole 16 is vertically aligned with a corresponding bore 12. The diameters of each hole and corresponding bore are the same. A separate drill bit 18 is disposed slidably within each bore.

The various bore diameters can each be selected to be slightly larger than the corresponding bits whereby each bit can only fit properly within the corresponding bore. Alternately, groups of bores can have like diameters corresponding to the diameter of the largest diameter bit to be employed therewith.

A vertical screw 20 extends through the inner end of the groove of the spiral to hold the spiral in position. The screw can threadedly engage a dead ended threaded bore in the cylinder or can extend all the way through an axial bore to engage a nut embedded in the bottom of the container. Alternatively, the cylinder can fit into a hollow vertical shell and the screw can engage a threaded bore or nut in the bottom of the shell.

A U shaped slider 22 slidably engages the spiral. A cover 24 which can be transparent rotatbly overlies the top end of the cylinder and the spiral. The cover has a rectangular slot or opening 26 extending radially outward from the center to the periphery. The cover also has an external loop or band 28 spaced from and aligned with the slot.

A slider support strip 30 horizontally overlies the cover with one end extending slidably within the band 28. Strip 30 has a rectangular window 32 overlying but in registration with slot 26 The legs of slider 22 extend upwardly through the slot 26 and window 32. A flat top plate 34 with a circular hole 36 aligned with the window 32 and slot 26 overlies the window, resting thereon and being secured to the top ends of the legs of slider 22.

When the cylinder is held in one hand and the cover is rotated, the slider 22 moves along the spiral and at the same time has to move along the slot. The slider movement can be reversed by reversing the direction of rotation of the cover. In this manner hole 36 can be aligned selectively with any selected hole 16 and its corresponding bore 12. Then the cylinder can be tilted or inverted and the bit in this bore slid out for removal or can be reinserted as desired. All other bits are held in position and cannot be removed.

The spiral can carry numbers in the top surface, each number being adjacent a corresponding hole and identifying the bit size. The strip has a pointer 38 thereon aligned with hole 36. When the cover is rotated to align the pointer with any number, the bit identified with that number is aligned with hole 36 ready for removal.

What is claimed is:

1. A device for removably storing a plurality of elongated drill bits of circular cross section, said bits having different diameters, said device comprising:

a vertical cylindrically shaped container having a top surface defining a flat horizontal spiral which has an inner end substantially coincident with the longitudinal axis of said container and has an outer end at the outer periphery of said surface, said spiral having a plurality of spaced holes disposed along the path defined by the spiral, whereby each bit can be removably disposed in a corresponding hole and extends in a direction parallel to said axis;

an elongated slider element having an opening therein and slidably engaging said spiral whereby said element can be moved back and forth therealong, said opening overlying said spiral; and a circular cover overlying said top end and manually rotatable thereabout, said cover having a radial slot therein extending from the center to the periphery, the element extending upwardly through said slot and being slidable therein whereby said opening can be selectively aligned with any one of said holes and access to all other holes is blocked simultaneously.

2. The device of claim 1 wherein said holes differ in diameter.

3. The device of claim 2 wherein said spiral has uniform width at all points along the spiral.

4. The device of claim 3 wherein any bit in the hole aligned with said opening is removable when the container is inverted.

5. The device of claim 4 wherein said container has a like plurality of spaced axially extending bores, each bore being aligned with a corresponding hole and being of like diameter therewith.

* * * * *